US005660192A

United States Patent [19]

Kim

[11] Patent Number: 5,660,192

[45] Date of Patent: Aug. 26, 1997

[54] HAIR CURLER

[75] Inventor: Hyeong Sook Morin Kim, Kowloon, Hong Kong

[73] Assignee: Georg Wiegner, Kowloon, Hong Kong

[21] Appl. No.: 489,338

[22] Filed: Jun. 12, 1995

[30] Foreign Application Priority Data

Jun. 14, 1994 [DE] Germany ..... 9409475 U
Jan. 18, 1995 [DE] Germany ..... 295 00 740.0

[51] Int. Cl.[6] ..... A45D 6/02; A45D 6/04

[52] U.S. Cl. ..... 132/237; 132/223; 132/226; 132/245

[58] Field of Search ..... 132/237, 219, 132/223, 226, 245, 250, 256, 227, 228, 246

[56] References Cited

U.S. PATENT DOCUMENTS

| | | | |
|---|---|---|---|
| Re. 27,033 | 1/1971 | Mitsumoto . | |
| T871,005 | 2/1970 | Freeman . | |
| 1,718,025 | 6/1929 | Bishinger . | |
| 1,994,099 | 3/1935 | Fulton . | |
| 2,166,386 | 7/1939 | Auster . | |
| 2,171,885 | 9/1939 | Michael . | |
| 2,331,065 | 10/1943 | Willat . | |
| 2,404,517 | 7/1946 | Molchan . | |
| 2,631,593 | 3/1953 | Madore . | |
| 2,708,941 | 5/1955 | Field . | |
| 2,747,585 | 5/1956 | Allen et al. . | |
| 2,825,344 | 3/1958 | Lenois . | |
| 2,838,053 | 6/1958 | Zimmerman . | |
| 2,874,706 | 2/1959 | Ficicchy . | |
| 2,941,534 | 6/1960 | Otto et al. . | |
| 2,972,994 | 2/1961 | Ferens . | |
| 3,045,685 | 7/1962 | Cormier . | |
| 3,073,318 | 1/1963 | Catania | 132/226 |
| 3,105,502 | 10/1963 | Mitchell . | |
| 3,106,213 | 10/1963 | Clare . | |
| 3,123,080 | 3/1964 | Brenn-Albertoni | 132/226 |
| 3,204,646 | 9/1965 | Chamberlin | 132/237 |
| 3,316,920 | 5/1967 | Cruise | 132/223 |
| 3,326,222 | 6/1967 | Rosenheim . | |
| 3,388,709 | 6/1968 | Morris . | |
| 3,530,863 | 9/1970 | Foster . | |
| 3,566,886 | 3/1971 | Solomon . | |
| 3,666,915 | 5/1972 | De Napoli . | |
| 3,675,663 | 7/1972 | Calandra . | |
| 3,700,853 | 10/1972 | Jensen et al. . | |

(List continued on next page.)

FOREIGN PATENT DOCUMENTS

| | | |
|---|---|---|
| 209014 | 5/1960 | Austria . |
| 0 197 208 | 4/1985 | European Pat. Off. . |
| 0 460 452 | 5/1991 | European Pat. Off. . |
| 1 247 508 | 11/1959 | France . |
| 1 404 587 | 5/1964 | France . |
| 2 382 212 | 3/1978 | France . |
| 2 503 996 | 4/1982 | France . |
| 2615079 | 5/1987 | France . |
| 17 93 426 | 2/1959 | Germany . |
| 4 26 125 | 12/1966 | Germany . |
| 1 238 632 | 4/1967 | Germany . |
| 14 57 375 | 3/1969 | Germany . |
| 15 57 333 | 1/1972 | Germany . |
| 23 38 330 | 2/1975 | Germany . |
| 75 05 892 | 10/1975 | Germany . |
| 24 26 028 | 12/1975 | Germany . |
| 26 22 364 | 12/1976 | Germany . |
| 20 02 226 | 2/1979 | Germany . |

(List continued on next page.)

*Primary Examiner*—Gene Mancene
*Assistant Examiner*—Pedro Philogene
*Attorney, Agent, or Firm*—Steven F. Caserza, Esq.; Flehr Hobach Test Albritton Herbert

[57] ABSTRACT

The invention relates to a curler having a roller made of a plastic or latex material and a self-gripping tape which is seated thereon, the self-gripping tape covering a central portion of a circumferential surface of the roller designed as a soft roll and consisting of a closed-cell foam, and the roller exhibiting, on both sides of the central portion, in each case one uncovered portion which occupies from 18 to 35% of a length of the roller.

8 Claims, 1 Drawing Sheet

U.S. PATENT DOCUMENTS

| | | | |
|---|---|---|---|
| 3,759,271 | 9/1973 | Caruso . | |
| 3,812,866 | 5/1974 | Morane . | |
| 3,881,500 | 5/1975 | Shinbashi et al. . | |
| 3,923,068 | 12/1975 | Gilman . | |
| 3,943,946 | 3/1976 | Gallegos . | |
| 4,298,787 | 11/1981 | Barradas . | |
| 4,431,012 | 2/1984 | Albertoni . | |
| 4,465,084 | 8/1984 | Fulgoni . | |
| 4,516,011 | 5/1985 | Jeffress et al. . | |
| 4,577,647 | 3/1986 | Fenster et al. | 132/246 |
| 4,638,821 | 1/1987 | Smith . | |
| 4,687,010 | 8/1987 | Caruso . | |
| 4,699,159 | 10/1987 | Thaler . | |
| 4,771,797 | 9/1988 | Kosaka . | |
| 4,989,621 | 2/1991 | Keller . | |
| 5,007,443 | 4/1991 | Fulgoni . | |
| 5,117,090 | 5/1992 | Askins . | |
| 5,144,968 | 9/1992 | Rivera . | |
| 5,255,694 | 10/1993 | Caruso . | |
| 5,263,501 | 11/1993 | Maznik . | |
| 5,286,949 | 2/1994 | Simons . | |
| 5,309,930 | 5/1994 | Presser . | |
| 5,522,408 | 6/1996 | Wiegner | 132/227 |

FOREIGN PATENT DOCUMENTS

| | | |
|---|---|---|
| 30 05 837 | 9/1980 | Germany . |
| 3 309 241 | 3/1983 | Germany . |
| 32 30 357 | 2/1984 | Germany . |
| 3 616 076 | 11/1987 | Germany . |
| 18 51 705 | 11/1991 | Germany . |
| 4018 202 | 12/1991 | Germany . |
| 354905 | 7/1961 | Switzerland . |
| 2 192 786 | 1/1988 | United Kingdom . |
| 88/00445 | 1/1988 | WIPO . |

HAIR CURLER

CROSS-REFERENCE TO RELATED APPLICATIONS

This application is related to the following U.S. patent applications:

| Ser. No. | Filing Date |
|---|---|
| 08/408,598 | March 22, 1995 |
| 08/138,635 | October 15, 1993 |
| 08/284,095 | August 1, 1994 |
| 08/267,599 | June 28, 1994 |
| 08/261,258 | June 17, 1994 |

TECHNICAL FIELD

The invention relates to a hair curler comprising a cylindrical roller made of a plastic or latex material and a self-gripping tape placed externally to the roller providing the curler with outwarded projections to form a self-sticking curler.

Such self-sticking hair curlers have the advantage that they can be handled without a clasp, a cross-clip or another type of closure mechanism and, as such, merely consists of an approximately round body. Outwardly projecting self-gripping protrusions of a self-gripping tape seated on a curling body come directly into operative connection with the hair and retain the curler in the hair after rolling up.

It has, however, been shown to be disadvantageous that such curlers are heavier than conventional curlers, which increases the tendency of such self-sticking curlers to unroll in the hair and thus reduces the advantage of not requiring any closure mechanism. This applies, in particular, to curlers with relatively large diameters.

An object of the invention is thus to provide a curler, which is light and has a good retaining force.

SUMMARY

This invention provides a curler which exhibits a reduced covering with a self-gripping tape. By virtue of the thus reduced weight of the curler, the good retaining force of the curler is achieved even with less of a self-gripping band. The gripping of the reduced tape in the hair is so high that the curler, as a result of the lower weight, has an improved fixing behavior with respect to prior art curlers. Consequently, there is no tendency to unroll after the hair has been wound up. In conjunction with designing the roller as a soft roller using a closed-cell foam, the reduced covering with the self-gripping tape can give full rein to its advantages since the low weight is combined with a soft structure, which favors the use as a night-time curler. Furthermore, the closed-cell foam promotes the resistance of the curler against chemicals which may be contained in hair-treatment agents. The curler can thus have a double function: on the one hand, as a normal hair curler for winding up wet hair for drying or as a permanent-wave curler in conjunction with chemical hair-treatment agents.

As a result of the uncovered portions on both sides, the curler does not tend to become entangled with the hair, as is the case with most other self-sticking curlers. After use, it can be removed from the hair easily.

The curler is thus also particularly suitable for permanent waves, where retaining bands would leave behind undesired markings in the hair.

Preferably, only approximately half of the roller is covered by the self-gripping tape. Such a curler weighs less than half the conventional curlers.

A preferred plastic material is environmentally friendly polyethylene, as a result of which the curler is additionally resistant to chemicals which are normally contained in hair-treatment agents such as permanent-waving agents.

The self-gripping tape may, just as a touch-and-close band, exhibit attachment protrusions. Said attachment protrusions are preferably formed by cut-open loops of a nylon monofilament, thus resulting in hooks. Said hooks may be deformed to mushroom-like bristles by a heat process. Such a tape with mushroom-like bristles likewise has advantageous self-griping properties.

The curler may be produced in various diameters and lengths.

Further embodiments and advantages of the invention are given in the claims and the following description.

BRIEF DESCRIPTION OF THE DRAWINGS

The invention is explained in more detail hereinbelow with reference to the exemplary embodiment represented in the attached drawing, in which.

DETAILED DESCRIPTION

Figure 1:
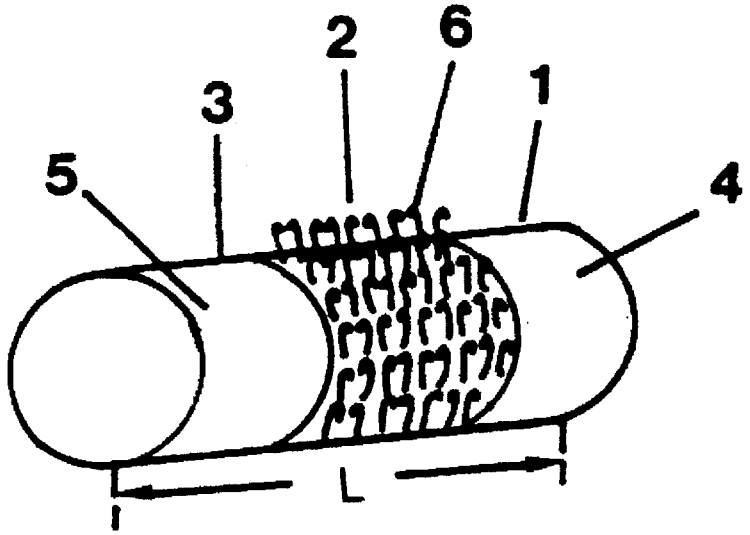
FIG. 1 shows, schematically, a perspective side view of a first preferred embodiment of a curler.

The curler represented in FIG. 1 is a self-sticking curler having a roller 1 on which a self-gripping tape 2 is seated.

The roller 1 is preferably a solid body consisting of a plastic or latex material. Preferably, the roller 1 consists of a foamed plastic, in order to design the roller 1 as a soft body. Production can take place by the extrusion and cutting-to-length of cylinder portions. A closed-cell foam can be used as foamed plastic. Polyethylene is preferred as plastic material.

A circumferential surface 3 of the roller 1 is covered, in a central portion, by the self-gripping tape 2, which covers or sheaths the roller 1 in said central region. On both sides of the tape 2, the roller 1 exhibits uncovered portions 4, 5, that is to say regions of the roller 1 which are not covered by the self-gripping tape 2 and each occupying from about 18 to 35% of a length L of the roller 1. Preferably, approximately half of the length L of the roller 1 is sheathed by the self-gripping tape 2.

The non-covered portions 4, 5 form at the respectively free ends of the roller 1 are preferably approximately of the same length, since the resulting symmetry of the curler simplifies the handling thereof.

The self-gripping tape 2 is attached in the hair of its own accord and is in the form of a hook-type band with a multiplicity of distributed, outwardly projecting hooks or bristle-like protrusions 6. The hooks 6 may be formed by cut-open loops of a nylon monofilament. The self-gripping tape is preferably pushed, in the form of a wide ring, onto the roller 1 and retained there via an annular width which is adapted to a respective diameter of the roller 1. Further fastening can take place by means of adhesive bonding or welding.

The diameter of the roller 1 may vary between about 8 and 50 mm, and the length L may vary between about 50 and 80 mm, in particular 55 to 70 mm.

Figure 2:
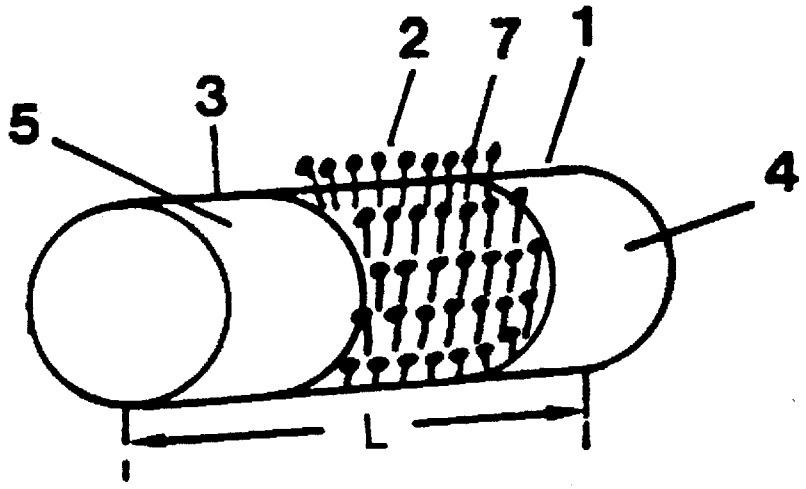
FIG. 2 shows, schematically, a perspective side view of a second preferred embodiment of a curler.

In a second preferred embodiment, represented in FIG. 2, a curler differs from the above described embodiment of FIG. 1 in that the self-gripping tape 2 is formed by a mushroom-type band. In this embodiment, the self-gripping tape 2 includes a multiplicity of distributed, outwardly projecting mushroom protrusions 7. The mushroom-like configuration of the protrusions 7 may be achieved by a mushroom-like deformation of the hooks 6 (FIG. 1) using heat. Otherwise, the remarks in conjunction with FIG. 1 apply here correspondingly.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed:

1. A hair curler comprising a roller and a self-gripping tape being seated thereon, said roller being of a soft roll consisting of a closed-cell foam which provides the roller with a circumferential surface being resistant against chemical hair-treatment agents, and said self-gripping tape comprising outwardly projecting attachment protrusions for retaining the curler in the hair after rolling up, and covering a central portion of said circumferential surface of the roller while on both sides of said central portion uncovered portions are maintained which, respectively, exhibit the circumferential surface of the roller along a length of the roller of approximately 18 to 35%.

2. The curler according to claim 1 wherein said self-gripping tape covers at least half the length of the roller.

3. The curler according to claim 1 wherein said roller is made of foamed polyethylene.

4. The curler according to claim 1 wherein the self-gripping tape is formed by a hook-type band with outwardly projecting protrusions comprising cut-open loops of a nylon monofilament.

5. The curler according to claim 1 wherein the self-gripping tape is formed by a bristle-type band with outwardly projecting protrusions comprising cut-open loops of a nylon monofilament which are deformed in the manner of mushrooms by heat treatment.

6. The curler according to claims 1, 2, 3, 4, or 5, wherein the roller has a diameter in the range of approximately 8 and 50 mm.

7. The curler according to claim 1 wherein the roller has a length in the range of approximately 50 and 80 mm.

8. The curler according to claim 1 wherein the roller has a length in the range of approximately 55 and 70 mm.

* * * * *